US012247346B2

(12) United States Patent
Merrow et al.

(10) Patent No.: US 12,247,346 B2
(45) Date of Patent: Mar. 11, 2025

(54) DRYER WITH EXTERNAL VENT

(71) Applicant: WHIRLPOOL CORPORATION, Benton Harbor, MI (US)

(72) Inventors: Eric W. Merrow, Benton Harbor, MI (US); Marcos Javier Rios, St. Joseph, MI (US); Brian K. Rogers, Watervliet, MI (US); Dennis J. Tuckowski, Stevensville, MI (US); Nicholas B. Vaive, St. Joseph, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 641 days.

(21) Appl. No.: 17/557,152

(22) Filed: Dec. 21, 2021

(65) Prior Publication Data

US 2023/0193551 A1 Jun. 22, 2023

(51) Int. Cl.

| | |
|---|---|
| ***D06F 58/24*** | (2006.01) |
| ***D06F 58/04*** | (2006.01) |
| ***D06F 58/10*** | (2006.01) |

(52) U.S. Cl.

CPC ..... *D06F 58/24* (2013.01); *D06F 58/04* (2013.01); *D06F 58/10* (2013.01)

(58) Field of Classification Search

None

See application file for complete search history.

(56) References Cited

U.S. PATENT DOCUMENTS

| | | | | |
|---|---|---|---|---|
| 8,347,520 | B2 * | 1/2013 | Kuwabara | D06F 58/206 34/73 |
| 10,494,756 | B2 * | 12/2019 | Beers | D06F 58/10 |
| 12,134,853 | B2 * | 11/2024 | Kang | D06F 58/10 |
| 2017/0198428 | A1 * | 7/2017 | Lv | F04C 23/001 |
| 2018/0237980 | A1 * | 8/2018 | Xu | D06F 58/206 |
| 2020/0370235 | A1 * | 11/2020 | Kang | B01D 46/4272 |
| 2021/0189636 | A1 * | 6/2021 | Rios Acebal | D06F 25/00 |

FOREIGN PATENT DOCUMENTS

WO 2021058365 A1 4/2021

* cited by examiner

*Primary Examiner* — David J Laux

(74) *Attorney, Agent, or Firm* — Brooks Kushman P.C.

(57) ABSTRACT

A dryer includes a drum configured to accommodate an article; a blower configured to propel air to form an air circulation path into the drum, wherein the blower is upstream along the air circulation path from the drum; a condenser downstream from the drum along the air circulation path and configured to extract moisture from the air of the air circulation path; and a venting inlet located between the condenser and the blower along the air circulation path and configured to provide a first air pathway between the drum and an external atmosphere.

18 Claims, 2 Drawing Sheets

DRYER WITH EXTERNAL VENT

TECHNICAL FIELD

Aspects of the present disclosure relate to dryers having an external vent, and more particularly, to condensing dryers having an external vent inlet and an external vent outlet.

BACKGROUND

Condensing dryers (a.k.a. ventless dryers) has becoming increasingly popular due to the fact that such dryers do not require external ventilation. While in use, the dryer pumps hot air into the drum where wet clothes are located. The hot air absorbs moisture from the clothes. Then the wet hot air enters a heat exchanger (e.g., a condenser) to cool down and release the moisture. The air is then reheated and pumped into the drum again. Conventionally, the circulation is conducted within a closed loop without an external venting inlet or outlet.

Although conventional condensing dryers are efficient, the lack of external venting may cause various airflow concerns.

SUMMARY

In one or more illustrative embodiments of the present disclosure, a dryer includes a drum configured to accommodate an article; a blower configured to propel air to form an air circulation path into the drum, wherein the blower is upstream along the air circulation path from the drum; a condenser downstream from the drum along the air circulation path and configured to extract moisture from the air of the air circulation path; and a venting inlet located between the condenser and the blower along the air circulation path and configured to provide a first air pathway between the drum and an external atmosphere.

In one or more illustrative embodiments of the present disclosure, a dryer includes a drum configured to accommodate clothes; a housing configured to accommodate the drum; a blower configured to propel air to form an air circulation path into the drum, wherein the blower is upstream along the air circulation path from the drum; a heat exchanger downstream from the drum along the air circulation path and configured to extract moisture from the air circulation path; a first venting port located attached to the housing configured to provide a first air pathway between the drum and an external atmosphere; and a first venting door connected to the first venting port configured to open when the blower is not in operation, and close when the blower is in operation.

In one or more illustrative embodiments of the present disclosure, a dryer apparatus includes a drum configured to accommodate clothes items; a blower configured to propel air to form an air circulation path into the drum, wherein the blower is upstream to the drum; a heat exchanger downstream to the drum on the air circulation path and configured to extract moister from the air circulation path, wherein the air circulation path defines a high-pressure side where the air pressure is higher than the air pressure of an external atmosphere and a low-pressure side where the air pressure is lower than the air pressure of the external atmosphere when the blower is in operation; and a venting inlet located at the low-pressure side of the air circulation path and configured to provide a first air pathway between the drum and an external atmosphere.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

A condensing dryer operates in a closed loop while drying the clothes in the drum. When operating in a closed loop, the dryer provides little to no air exchange between the internal circulation path and the external environment. While in a non-operating state, an air path to the external environment may be desired to provide fresh air to the drum.

Figure 1:
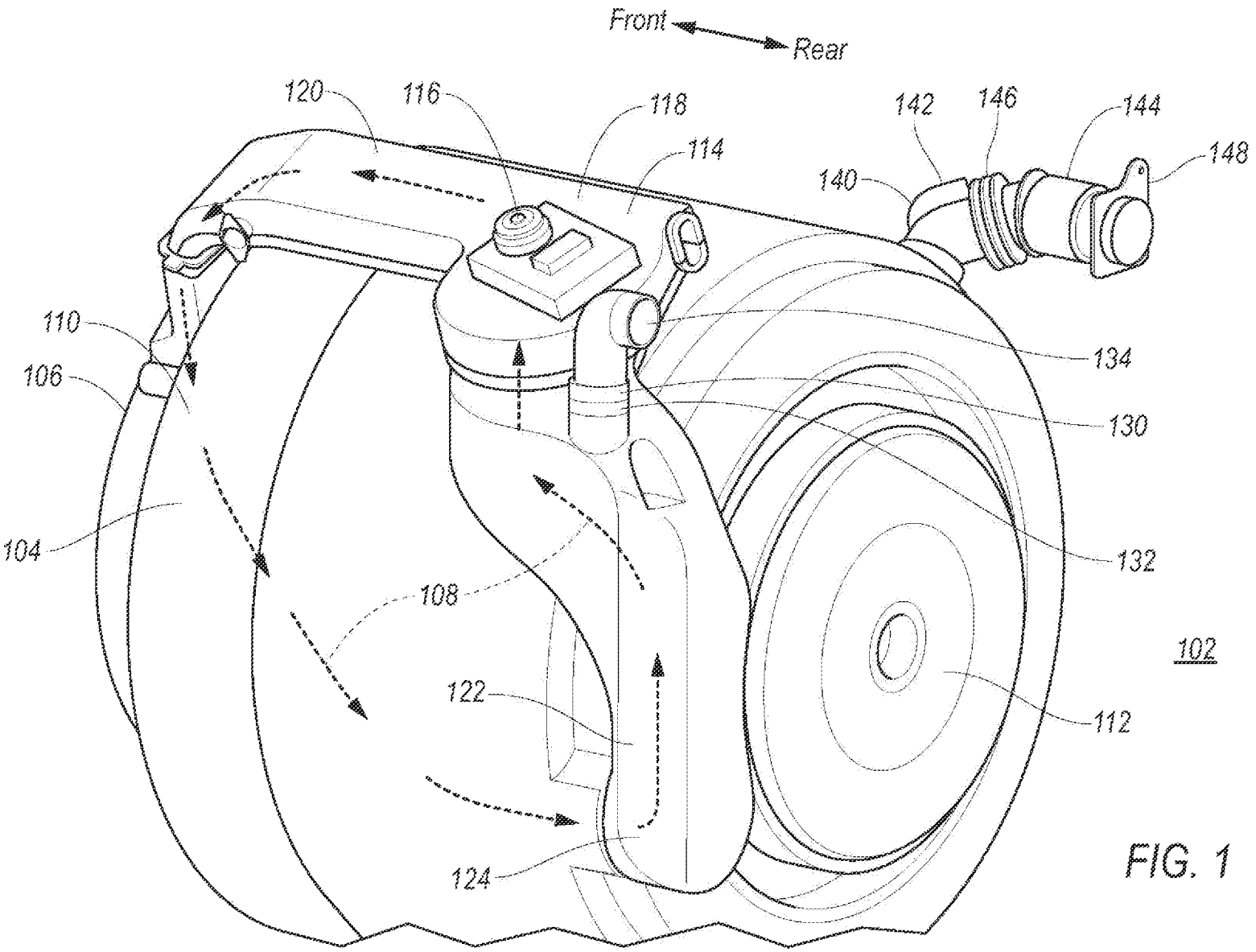
FIG. 1 illustrates an example condensing dryer provided with an external venting inlet and an external venting outlet of one embodiment of the present disclosure.

Referring to FIG. 1, an example condensing dryer having an external venting inlet and an external venting outlet is illustrated, in accordance with one or more embodiments of the present disclosure. FIG. 1 illustrates a perspective view of the condensing dryer from the rear side. A condensing dryer 102 may include a drum 104 that constitute a main body part of the condensing drying. The drum 104 may include a cylindrical side wall and a closed end coupled to the cylindrical side wall. The cylindrical side wall and the closed end may form a cavity configured to accommodate clothes items for drying purposes. Opposite to the closed end, an open end 106 may be provided through which the clothes may be loaded and unload from the drum 104. A front door (not shown) may be provided at the open end 106 to allow the cavity of the drum 104 to be sealed while in operation, such that a closed loop internal air circulation path 108 may be formed within the dryer 102. The drum 104 may be located within a housing member 110. In one example, the housing member 110 may be cylindrically shaped to accommodate the generate contour of the drum 104.

A drum motor 112 may be attached to the housing member 110 and configured to rotate the drum 104 relative to the housing member 110 during the drying operation. The drum motor 112 may be a single speed electric motor power by electricity supplied from a power outlet (not shown) through a control circuit (not shown). Alternatively, the drum motor 112 may be a variable speed electric motor configured to adjust the rotation speed of the drum in adaptation to various design needs.

The dryer 102 may be provided with a blower 114 configured to propel air within the circulation path 108. The blower 114 apparatus may include a fan motor 116 as well as a blower wheel 118 coupled to the fan motor 116. The fan motor 116 may be a single speed or variable speed electric motor powered by electricity supplied from a power outlet. The fan motor 116 may be controlled by a control circuit to provide rotational force to the blower wheel 118 to enable the air circulation within the circulation path 108. The blower wheel 118 may include a plurality of blades. Once started to rotate, the blower wheel 118 may produce a positive air pressure on one side of the blades and negative air pressure on another side of the blades, such that the air pressure difference draws air into circulation in a predefined direction forming the circulation path 108.

The dryer 102 may be further provided with a heating element 120 located downstream to the blower 114. The heating element may include one or more electrically resistive elements or wires configured to heat the air within the circulation path 108 before the air enters the drum 104.

The circulation path 108 may involve a closed or semi-closed air pathway, starting from the blower 114 passing through the heating element 120, entering the drum 104 and then feeding to a condenser (to be discussed below) before finally returning to the blower 114. The circulation path 108 may be divided into a high-pressure side and a low-pressure side. On the high-pressure side, the air pressure on the circulation path 108 is above the air pressure of the external atmosphere. The high-pressure side may involve the drum 104. On the low-pressure side, the air pressure on the circulation path 108 is below the air pressure of the external atmosphere. The low-pressure side may involve an air duct 124 (to be discussed below) after a condenser 122 and before the blower 114 along the circulation path 108.

As noted above, the dryer 102 may be further provided with the condenser 122 (or heat exchanger) inside an air duct 124 located in the air circulation path 108 downstream the drum 104. The condenser 122 may be configured to cool down the air from the drum 104. During operation, wet clothes may be positioned inside the drum 104 and the hot air follow in and out the drum 104 may absorb the moisture from the clothes. Once fed into the condenser 122, the moisture in the hot air may condensate into water and the dried cool air may be circulated into the blower 114 to continue the drying cycle. The water condensed by the condenser 122 may be drained from the dryer 102 through mechanisms such as a hose (not shown). The condenser 122 may be implemented in various manners. For instance, refrigerant may be used in the condenser 122 to provide a cooling effect.

The dryer 102 may be further provided with an external venting inlet 130 connected to the air duct 124 between the condenser 122 and the blower 114. The venting inlet 130 may be configured to provide an air pathway connecting the air circulation path 108 and the external environment. In the present example, the venting inlet 130 extents vertically from the air duct 124. Alternatively, the venting inlet 130 may extent horizontally from the air duct 124 based on different design needs. Since the venting inlet 130 is located at upstream to the blower 114 (i.e., on the low-pressure side of the circulation path 108), a negative pressure may occur at the venting inlet 130 when the blower 114 is activated. The negative pressure may draw a fresh air from the outside into the circulation path 108 via the venting inlet 130. Since the fresh air may be of a lower humidity compared with the recirculated air from the drum 104, drying efficiency of the dryer 102 may be improved.

While the dryer 102 is not in operation, the venting inlet 130 may provide an air pathway between the drum 104 and the external atmosphere. In the present example, the venting inlet 130 may be open (i.e., without use of an inlet closing mechanism 132). Alternatively, an inlet closing mechanism 132 such a flap door may be attached to the venting inlet 130 and configured to selectively open and close the venting inlet 130 from the external atmosphere. The inlet closing mechanism 132 may be configured to open by default (e.g., via a tensioner such as a spring) and to close the venting inlet 130 during a drying cycle when the blower 114 is in operation. The inlet closing mechanism 132 may be controlled by an electronic switch operated by a control circuit (not shown). Alternatively, the inlet closing mechanism 132 may be controlled by an air pressure difference between the external atmosphere and the low-pressure side of the circulation path 108. Due to the upstream location to the blower 114, the venting inlet location in the air duct 124 will have a negative pressure compared to the external atmosphere when the blower 144 is in operation. The inlet closing mechanism 132 may be configured to automatically close the venting inlet 130 when the air pressure in the air duct 124 at the location of the venting inlet is reduced below a predefined threshold when the blower 114 operates such that no fresh air enters the circulation path 108 via the venting inlet during a drying cycle. An adaptor 134 may be coupled to the venting inlet 130 to modify the size and direction of the inlet port in adaptation to various design needs.

The dryer 102 may be further provided with an external venting outlet 140 mounted on the housing member 110 and configured to provide an air pathway connecting the air circulation path 108 and the external environment. In the present example, the venting outlet 140 may be located at a high-pressure side of the air circulation path 108 downstream to the blower 114. The venting outlet 140 may include a first rigid portion 142 coupled to a second rigid portion 144 via a flexible portion 146 to accommodate various design needs. An outlet closing mechanism 148 may be coupled to the venting outlet 140 configured to selectively open and close the venting outlet 140. When the dryer 102 is not in operation, the outlet closing mechanism 148 may open to allow air communication between the drum 104 and the external atmosphere. The outlet closing mechanism 148 may be configured to open by default (e.g., via a tensioner such as a spring). When the dryer 102 is in operation, the outlet closing mechanism 148 may close to prevent the hot air on the high-pressure side of the circulation path 108 to escape to the external atmosphere. The inlet closing mechanism 132 may be controlled by a control circuit (not shown). Alternatively, the outlet closing mechanism 148 may be controlled by an air pressure difference between the high-pressure side of the circulation path 108 and the external atmosphere. The outlet closing mechanism 148 may be configured to automatically close the venting outlet 140 when the air pressure in the drum 104 is increased above a predefined threshold when the blower 114 operates such that no hot air escapes from the circulation path 108 via the venting outlet 140 during a drying cycle.

Figure 2:
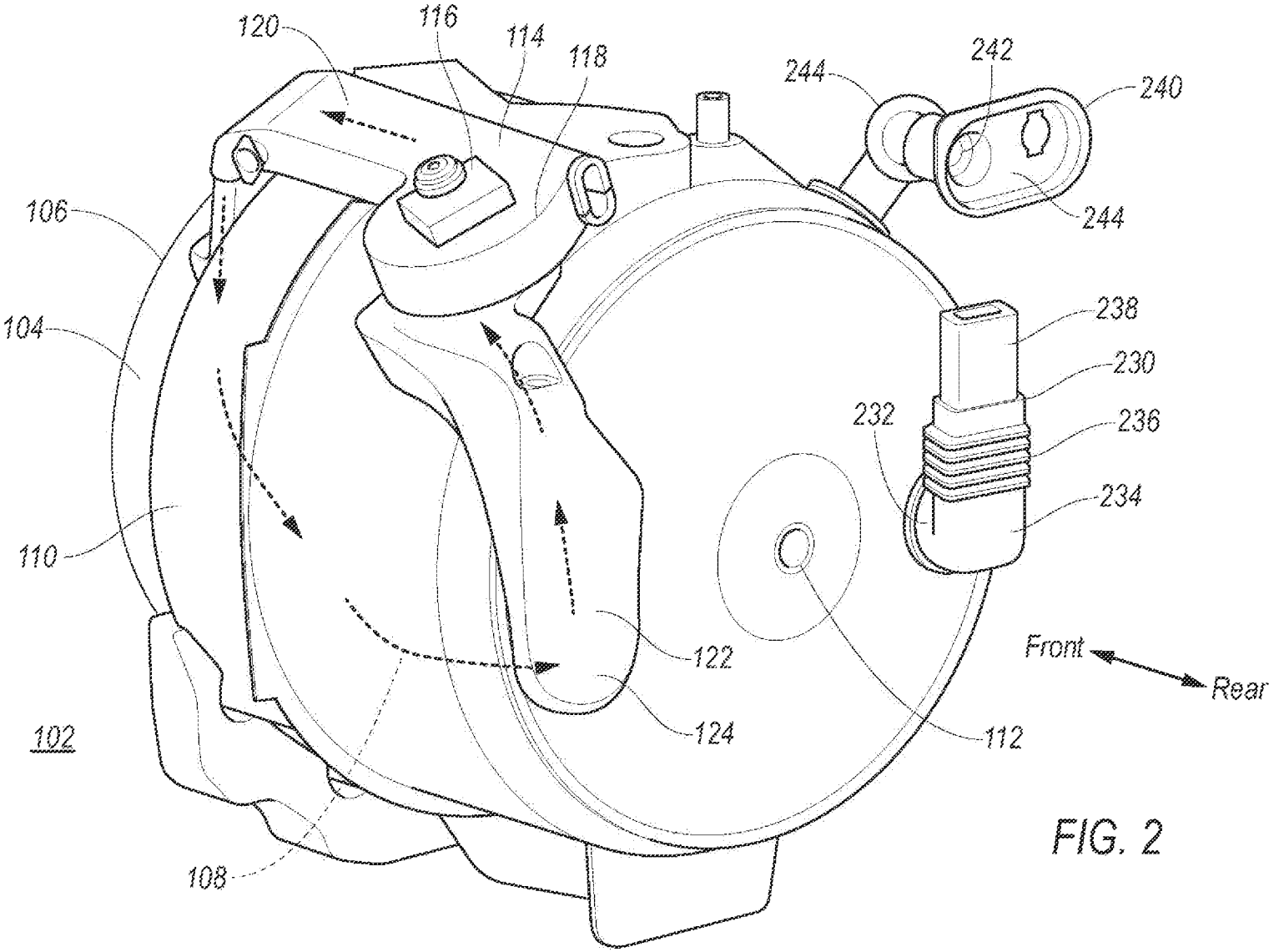
FIG. 2 illustrates an example condensing dryer provided with an external venting inlet and an external venting outlet of another embodiment of the present disclosure.

Referring to FIG. 2, an example condensing dryer 102 having an external venting inlet 230 and an external venting outlet 240 of another embodiment of the present disclosure is illustrated. As compared to the example illustrated with reference to FIG. 1, a venting inlet 230 is located on the high-pressure side of the circulation path 108 in the present example.

The venting inlet 230 may be horizontally provided with the rear end of the housing member 110 and provide a pathway between the drum 104 and the external atmosphere. Since the venting inlet 230 is provided at the high-pressure side of the circulation path 108, an inlet closing mechanism 232 may be attached to the venting inlet 230 and configured to selectively open and close the venting inlet 130 from the external atmosphere. The inlet closing mechanism 232 may be configured to open by default (e.g., via a tensioner) and close the venting inlet 230 during a drying cycle when the blower 114 is in operation. The inlet closing mechanism 232 may be controlled by an electronic switch operated by a control circuit (not shown). Alternatively, the inlet closing mechanism 232 may be controlled by an air pressure difference between the high-pressure side of the circulation path 108 and the external atmosphere. As the blower 114 starts to operate, the air pressure on the high-pressure side of the circulation path 108 will increase. Once the air pressure difference is above a predefined threshold, the inlet closing mechanism 232 may automatically close which shuts the air pathway between the drum 104 and the external atmosphere. Once the air pressure difference is reduced below the predefined threshold (i.e., the blower 144 stops operating), the inlet closing mechanism 232 may automatically open due to the force applied from the tensioner to enable the air pathway. One or more adapters may be connected to the venting inlet 230 to accommodate various design needs. As illustrated in FIG. 2, adapter includes a first rigid portion 234, a flexible portion 236 and a second rigid portion 238 and changes the direction of the venting inlet 230 by 90 degrees.

The dryer 102 may be further provided with an external venting outlet 240 attached to a side wall of the housing member 110 and provide a pathway between the drum 104 and the external atmosphere. In the present example, the direction of the venting outlet 240 may be perpendicular to the direction of the venting inlet 230. Since the venting outlet 240 is provided at the high-pressure side of the circulation path 108, a closing mechanism 242 may be attached to the venting outlet 240 and configured to selectively open and close the venting inlet 130 from the external atmosphere. The operations of the venting outlet 240 may be similar to the operations of the venting inlet 230 and/or the venting outlet 140 discussed with reference to FIG. 1 and thus will not be repeated here. One or more adaptors 244 may be provided and attached to the venting outlet 240 to accommodate various design needs. In the present example, the adaptor 244 changes the direction of the venting outlet 240 by 90 degrees. The venting outlet 240 may be further connected to a hot value of the dryer 102.

It is noted that the inlet closing mechanism 132, 232 and the outlet closing mechanism 148, 242 in both embodiments discussed above are merely examples and may be implemented in various manners. For instance, the inlet and/or outlet closing mechanisms may be directly coupled to the venting inlet 130, 230 and/or outlet 140, 240 without an adaptor in between. Alternatively, the inlet and/or outlet closing mechanism may be connected to the venting inlet 130, 230 and/or outlet 140, 240 via one or more adaptors to achieve essentially the same effect. It is further noted that the term "dryer" is used as a general term in the present disclosure and may include any device having the drying function. For instance, the dryer 102 in the present disclosure includes a washing machine having a drying function.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their broadest reasonable constructions and their ordinary meanings as understood by those knowledgeable in the technologies described herein unless an explicit indication to the contrary is made herein. In particular, use of the singular articles such as "a," "the," "said," etc. should be read to recite one or more of the indicated elements unless a claim recites an explicit limitation to the contrary.

The abstract of the disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A dryer comprising:

a drum configured to accommodate an article;

a blower configured to propel air to form an air circulation path into the drum, wherein the blower is upstream along the air circulation path from the drum;

a condenser downstream from the drum along the air circulation path and configured to extract moisture from the air of the air circulation path; and a venting inlet located between the condenser and the blower along the air circulation path and configured to provide a first air pathway between the drum and an external atmosphere;

a housing member configured to accommodate the drum;

a venting outlet attached to the housing member configured to provide a second air pathway between the drum and the external atmosphere; and an outlet door connected to the venting outlet and configured to open when the dryer is not in operation, and close when the dryer is in operation.

2. The dryer of claim 1, wherein the dryer is configured to control the outlet door based on an air pressure difference between the drum and the external atmosphere, such that responsive to the air pressure difference being greater than a threshold, the dryer is configured to close the outlet door.

3. The dryer of claim 1, wherein the outlet door is directly coupled to the venting outlet.

4. The dryer of claim 1, wherein the outlet door is connected to the venting outlet via an adaptor configured to change the direction of the venting outlet.

5. The dryer of claim 1, wherein the venting outlet is perpendicular to the venting inlet.

6. The dryer of claim 1, wherein the venting outlet is connected to a hot valve of the dryer.

7. The dryer of claim 1, wherein the venting inlet is configured to directly provide the first air pathway between the drum and the external atmosphere without a door.

8. The dryer of claim 1, further includes an adapter connected to the venting inlet.

9. A dryer, comprising:

a drum configured to accommodate clothes;

a housing configured to accommodate the drum;

a blower configured to propel air to form an air circulation path into the drum, wherein the blower is upstream along the air circulation path from the drum;

a condenser downstream from the drum along the air circulation path and configured to extract moisture from the air circulation path;

a first venting port located attached to the housing configured to provide a first air pathway between the drum and an external atmosphere; and a first venting door connected to the first venting port configured to open when the blower is not in operation, and close when the blower is in operation.

10. The dryer of claim 9, further comprising:

a second venting port located attached to the housing configured to provide a second air pathway between the drum and an external atmosphere; and a second venting door connected to the second venting port configured to open when the blower is not in operation, and close when the blower is in operation.

11. The dryer of claim 10, wherein the first venting port is perpendicular to the second venting port.

12. The dryer of claim 10, wherein at least one of the first venting door or the second venting door is controlled based on air pressure difference between the drum and the external atmosphere, responsive to the air pressure difference being greater than a threshold, at least one of the first venting door or the second venting door closes.

13. The dryer of claim 11, wherein the second venting port is connected to a hot valve.

14. The dryer of claim 9, further comprising:

an adaptor connected to the first venting port, the adaptor includes, a first rigid portion connected to the first venting port, a flexible portion connected to the first rigid portion, and a second rigid portion connected to the flexible portion.

15. A dryer apparatus comprising:

a drum configured to accommodate clothes items;

a blower configured to propel air to form an air circulation path into the drum, wherein the blower is upstream to the drum;

a heat exchanger downstream to the drum on the air circulation path and configured to extract moisture from the air circulation path, wherein the air circulation path defines a high-pressure side where the air pressure is higher than the air pressure of an external atmosphere and a low-pressure side where the air pressure is lower than the air pressure of the external atmosphere when the blower is in operation; and a venting inlet located at the low-pressure side of the air circulation path and configured to provide a first air pathway between the drum and an external atmosphere atmosphere;

a venting outlet at the high-pressure side of the circulation path and configured to provide a second air pathway between the drum and the external atmosphere; and an outlet door connected to the venting outlet and configured to open when the dryer is not in operation, and close when the dryer is in operation.

16. The dryer apparatus of claim 15, wherein the venting inlet is perpendicular to the venting outlet.

17. The dryer apparatus of claim 15, wherein the outlet door is controlled based on air pressure difference between the high-pressure side of the air circulation path and the external atmosphere, responsive to the air pressure difference being greater than a threshold, the outlet door closes.

18. The dryer of claim 15, wherein the venting inlet is located on the air circulation path upstream to the blower and downstream to the heat exchanger.

* * * * *